US007232269B2

(12) United States Patent
Ohyama

(10) Patent No.: US 7,232,269 B2
(45) Date of Patent: Jun. 19, 2007

(54) RECORDING APPARATUS

(75) Inventor: Kazuo Ohyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 68 days.

(21) Appl. No.: 11/092,828

(22) Filed: Mar. 30, 2005

(65) Prior Publication Data

US 2005/0168557 A1 Aug. 4, 2005

Related U.S. Application Data

(62) Division of application No. 10/658,659, filed on Sep. 10, 2003, now Pat. No. 6,896,432.

(30) Foreign Application Priority Data

Sep. 17, 2002 (JP) ..... 2002-269861

(51) Int. Cl.
*B41J 2/01* (2006.01)
*B41J 13/10* (2006.01)
*B41J 11/08* (2006.01)

(52) U.S. Cl. ..... 400/642; 400/636; 400/656; 347/104; 271/188

(58) Field of Classification Search ..... 400/642, 400/636, 646, 639, 648, 656, 662; 347/101, 347/104; 346/134; 271/188, 209
See application file for complete search history.

(56) References Cited

U.S. PATENT DOCUMENTS 5,847,719 A * 12/1998 Yamaguchi et al. ..... 346/134
5,874,979 A 2/1999 Ohyama ..... 347/104
5,940,092 A 8/1999 Kashimura et al. ..... 347/8
6,616,361 B2 9/2003 Sugiyama ..... 400/642
6,652,091 B2 * 11/2003 Tanno ..... 347/104
6,712,463 B2 3/2004 Matsumoto ..... 347/104
2002/0067942 A1 6/2002 Sugiyama ..... 400/578
2002/0171727 A1 11/2002 Kida et al. ..... 347/104

FOREIGN PATENT DOCUMENTS

EP 1053883 A2 * 11/2000
JP 09086749 A * 3/1997
JP 09193373 A * 7/1997
JP 2000-71532 3/2000
JP 2000-158644 6/2000
JP 2000335801 A * 12/2000

* cited by examiner

*Primary Examiner*—Leslie J. Evanisko
(74) *Attorney, Agent, or Firm*—Fitzpatrick, Cella, Harper & Scinto

(57) ABSTRACT

Ridges and grooves are alternately formed on a platen in the direction of transporting sheets. Wave holding spurs are rotatably supported by torsion springs downstream of a recording area, and pressed against the grooves. Sheet discharge roller pairs are disposed generally downstream from the grooves. Recording sheets exhibit cockling which rises up toward a recording head due to swelling from ink, but a substantial amount of the swelling is contained in the grooves, so the cockling does not come into contact with the recording head, and further, the peak-to-peak distance of the wave shapes of the recording sheets can be reduced. Following the leading edge of a recording sheet passing the sheet discharge roller pairs, the crests of the cockling are collapsed by transporting spurs and divided between wave holding spurs and the transporting spurs, and thus the peak-to-peak distance is further reduced, consequently preventing off-target landing of ink droplets.

1 Claim, 12 Drawing Sheets

RECORDING APPARATUS

This application is a division of application Ser. No. 10/658,659 filed Sep. 10, 2003 now U.S. Pat. No. 6,896,432.

BACKGROUND OF THE INVENTION

1. Field of the Invention

The present invention relates to an apparatus for recording on sheets with recording means, and particularly relates to the configuration of a particular part of an ink jet recording apparatus which records by discharging ink droplets from ink jet recording means, the part being the printing region and the areas upstream and downstream therefrom.

2. Description of the Related Art

In order to record with ink jet recording apparatuses in a stable manner, the effects of wrinkling and undulations (hereafter referred to as "cockling") upon ink being applied to recording sheets serving as a recording medium must be eliminated as much as possible, and also recording sheets which tend to curl due to the effects of humidity and the like must be kept from floating toward the head, so as to maintain the distance between the surface of the recording sheet and the recording head. This is because in the event that the recording sheet floats up so far as to come into contact with the recording head, this not only leads to soiling of the recording sheet due to ink droplets on the recording head being transferred thereto and smearing of the unfixed ink on the recording sheet, but also causes trouble such as clogging of the ink discharge orifices of the recording head.

Techniques for solving the above-described problems have been conventionally disclosed, such as in Japanese Patent Laid-Open No. 2000-071532 and Japanese Patent Laid-Open No. 2000-158644. A first conventional example according to Japanese Patent Laid-Open No. 2000-071532 will first be described, with reference to FIGS. 12 and 13.

An ink jet recording apparatus 100 comprises a transporting roller 102 serving as sheet transporting means, disposed upstream in the recording sheet transportation direction of a recording head 101, a pinch roller 103 which is pressed against the transporting roller 102 so as to be driven thereby, and sheet discharge rollers 104 and sheet discharge spurs 105 pressed against the sheet discharge rollers 104 so as to be driven thereby, which are provided downstream in the sheet transportation direction. The ink jet recording apparatus 100 further comprises a platen 106 for guiding the rear face of a recording sheet S at a position facing the recording head 101, with multiple ribs 107 and grooves 108 alternately formed on the upper face for forming waves in the sheet width direction of the recording sheet S. A sheet pressing plate 110 having protrusions 109 for guiding recording sheets S into the grooves 108 is provided upstream from the platen 106 in the sheet transportation direction. Also, wave holding spurs 112 for pressing the recording sheet S into the grooves 108 in the same way are provided downstream in the sheet transportation direction from the grooves 108. The sheet discharge rollers 104 and the sheet discharge spurs 105 are positioned downstream from each rib 107 of the platen 106 in the sheet transportation direction, and the height of the nip formed between the sheet discharge rollers 104 and the sheet discharge spurs 105 is arranged to be approximately the same height as the ribs 107.

With such a configuration, the behavior of the recording sheet S upon the platen 106 will be described with reference to FIG. 13, which is a view of the arrangement shown in FIG. 12 from the direction of the arrow C.

The recording sheet S which has passed beyond the sheet pressing plate 110 is provided with a wave shape such as indicated by the solid line S5. At this time, in the event that the recorded image is one of high concentration, recording ink which uses water as the primary medium thereof will have been ejected onto and absorbed into the recording sheet S in great amounts, so the recording sheet S becomes swelled. Now, the recording sheet S has the apexes of the waves immediately upstream from the recording area pressed between the ribs 107 and a horizontal portion 111 of the sheet pressing plate 110, and accordingly does not readily move even due to swelling. On the other hand, movement is not restricted at the multiple grooves 108, so stretching of the recording sheet S due to swelling primarily occurs at the grooves 108. The recording sheet S is displaced downwards beforehand by the protrusions 109, so cockling is sure to occur downwards, and the recording sheet S following recording assumes a form indicated by the dotted line S6. The recording sheet S upon which cockling such as indicated by S6 at the recording area is transported by the sheet discharge rollers 104 and sheet discharge spurs 105 with the cockling state maintained by the wave holding spurs 112. The sheet discharge roller pairs are disposed downstream from each rib 107, thereby being situated at the crest portion of each cockle, and accordingly maintaining the cockling state.

Also, with regard to curling of the recording sheet S due to the environmental conditions, the recording sheet S is provided with the wave shape upstream of the recording area, and the wave shape is maintained by the wave holding spurs 112 even after the trailing edge of the recording sheet S passes over the sheet pressing plate 110. Accordingly, the rigidity of the recording sheet S is increased and curling is corrected, so the recording sheet S is prevented from floating up towards to the recording head 101 side.

Next, a second conventional example according to Japanese Patent Laid-Open No. 2000-158644 will be described with reference to FIGS. 14 through 16. Description which would be repetitive of the description of the first conventional example will be omitted here.

An ink jet recording apparatus 200 comprises a transporting roller 202 serving as sheet transporting means, disposed upstream in the recording sheet transportation direction of a recording head 201, a pinch roller 203 which is pressed against the transporting roller 202 so as to be driven thereby, and sheet discharge rollers 204 and sheet discharge spurs 205 pressed against the sheet discharge rollers 204 so as to be driven thereby, which are provided downstream in the sheet transportation direction. The ink jet recording apparatus 200 further comprises a platen 206 for guiding the rear face of a recording sheet S at a position facing the recording head 201, with multiple ribs 207 and auxiliary ribs 208 shorter than the ribs 207 formed on the upper face for forming waves on the sheet width direction of the recording sheet S. The transporting roller 202 and the pinch roller 203 are arranged such that the pinch roller 203 is offset as to the transporting roller 202 in the direction of the platen 206 as shown in FIG. 15, which is a cross-sectional view along line XV-XV in FIG. 14, and with the nip portion thereof positioned above the ribs 207. Accordingly, the recording sheet S is pressed against the ribs 207 from an upper diagonal direction while being transported, and as indicated by the solid line S7 in FIG. 16, which is a view of that shown in FIG. 14 from the direction of the arrow D, the recording sheet S is provided with a wave formed wherein crests are formed at the ribs 207 and troughs are formed at the portions between the ribs 207. Also, the sheet discharge rollers 204 and the sheet discharge spurs 205 are positioned downstream from each rib 207 of the platen 206 in the sheet transportation direction, and wave holding spurs 209 for pressing the recording sheet S in between the ribs 207 and between the sheet discharge rollers 204 in the same way are also provided downstream.

With such a configuration, the behavior of the recording sheet S upon the platen 206 is such that it assumes a wave shape indicated by the solid line S7 before recording with the recording head 201 as shown in FIG. 16, and in the event that a high-concentration image has been recorded thereupon, stretching due to swelling of the recording sheet S between the ribs 207 and auxiliary ribs 208 occurs in the direction away from the recording head 201 as shown by dotted line S8.

However, there are problems with the above-described conventional examples. As a first problem, the shape of the waves and the depth of the troughs of the recording sheet change before and after the leading edge of the recording sheet reaches the wave holding spurs. The reason that this occurs is as follows. The shape of the waves, and consequently the depth of the troughs, formed upstream of the recording head by the sheet pressing plate 110 or by the offset of the pinch roller 203 as to the transporting roller 202, differ depending on the thickness and rigidity of the recording sheets, and further depending on the density of the fibers from one sheet to another, or even from one place to another within the same sheet. However, the height of the wave holding spurs 112 or 209 is set so as to be lower than the ribs 107 or 207 taking into consideration the tolerance of parts and assembly, in order to press the recording sheets between the ribs 107 or 207 in a sure manner. Accordingly, in many cases, the depth of the trough increases after the leading edge of the recording sheet reaches the wave holding spurs. Also, the wave holding spurs 209 are rotatably borne by torsion coil springs 210 so as to be capable of elastic movement, and are capable of moving a certain amount in the height-wise direction, but this arrangement is originally intended for providing wave shapes to the recording sheets, and accordingly cannot completely eliminate the effects.

Consequently, the distance between the recording head and the recording face of the recording sheet changes before and after the leading edge of the recording sheet reaches the wave holding spurs, and with multi-pass recording wherein scanning of the recording head is repeated for multiple sheet feeds for forming an image, there have been problems such as the ink droplets landing off-target, offset in image colors, overall coarseness, and so forth.

As a second problem, in the event that a high-concentration recording image is recorded on a recording sheet, swelling of the recording sheet occurs in the direction away from the recording head at the trough portion of the wave shapes of to the recording sheet beforehand, i.e., between the grooves 108 or between the ribs 207 and auxiliary ribs 208 of the platen, thereby preventing contact with the recording head, as already described with regard to the conventional art. However, this has negative effects as well, in that at portions where cockling occurs, the recording face of the recording sheet is distanced form the recording head, so the ink droplets land further off-target. Also, the massive wave effects of the region where cockling occurs act to distance the trough portions from the recording head for portions that have not been recorded on yet as well, so the ink droplets land far off-target in the same way.

Further, as a third problem, the depth of the wave shapes of the recording sheet changes between before and after the trailing edge of the recording sheet passing over the transporting roller 102 or 202. This occurs due to the entire width-wise area of the unrecorded face of the recording sheet changing from a state of being supported by the transporting roller to a state of being supported only by the ribs 107 or 207 of the platen. That is to say, in the state before the trailing edge of the recording sheet passes over the transporting roller, the entire width of the recording sheet is supported by the transporting roller at the time of providing wave shapes for troughs between the ribs 107 or 207 of the platen, which acts as drag. However, after the trailing edge of the recording sheet passes over the transporting roller, this drag does not act on the recording sheet any more, so the depth of the troughs increases. Consequently, there have been problems such as the ink droplets landing off-target, offset in image colors, overall coarseness, and so forth.

SUMMARY OF THE INVENTION

The present invention has been made in light of the above problems, and accordingly can provide a recording apparatus capable of maintaining the distance between the recording head and recording face of the recording sheet (hereafter referred to as "head-sheet distance") unchanged over the entire region from the leading edge of the recording sheet to the trailing edge thereof.

The present invention can also eliminate off-target landing of ink droplets as much as possible while preventing contact with the recording head, by generating cockling which occurs when a high-concentration image is recorded, not away from the recording head but toward the recording head, and also reducing the difference between the crests and troughs of the cockling (hereafter referred to as "P-P", which is short for "peak-to-peak").

A recording apparatus according to a first aspect of the present invention comprises transporting means for transporting recording sheets in a transportation direction; a platen positioned facing a recording head which records on the recording sheets, comprising a plurality of grooves and ridges extending in the transportation direction; and rotating members disposed downstream in the transportation direction from the recording head, and pressed against bottom surfaces of the grooves.

The recording apparatus may further comprise additional rotating members disposed downstream in the transportation direction from the recording head, and pressed against the ridges. The offset between the ridges and the grooves at positions where the rotating members are disposed is preferably 0.5 mm or less, and this value is preferably determined by the P-P value at the recording area of the wave shape provided upstream in the transportation direction. Also, the platen comprising wave shape providing means upstream in the transportation direction from the recording head may have a plurality of grooves and ridges extending in the direction of transportation of the recording sheets, wherein the recording sheets are provided with wave shapes such that crests are formed at the ridges and troughs are formed at the grooves.

Further, with the wave shape providing means comprising a transporting roller pair and the ridges and grooves upstream in the transportation direction from the recording head, the nip position of the transporting roller pair may be above the ridges, and of the transporting roller pair, the roller which comes in contact with the recording face of the recording sheet may be offset toward the recording head relative to the roller which comes in contact with the face of the recording sheet opposite to the recording face, so as to press the recording sheet against the platen.

The wave shape providing means may be a sheet guide member for guiding recording sheets to the ridges and grooves, having protrusions for guiding the recording sheets to the grooves, and the protrusions on the sheet guide member may be elastically deformable.

According to the first aspect of the present invention, rotating members which are equivalent to the wave shape holding spurs in the conventional example are disposed so as to be rotatably pressed against the grooves of the platen, whereby the height of the rotating members is determined in a sure manner, and further the depth of the troughs of the wave shapes of the recording sheets is determined by the grooves, so the head-sheet distance can be maintained in a stable manner over the entire length of the recording sheet, from the leading edge to the trailing edge.

Also, in the event that a high-concentration recording image has been recorded, the wave shapes are provided beforehand wherein the ridges of the platen forms crests and the grooves thereof form troughs, so though the amplitude of the wave shapes grows, how far down the troughs can go is determined by the grooves of the platen, and further the troughs are pressed there by the rotating members, so the swelling of the recording sheet is absorbed by spreading over the bottom of the grooves, and the swelling of the recording sheet which cannot be absorbed here spills over to the crest of the waves and grows into cockling which rises up somewhat toward the side of the recording head. Upon the leading edge of the recording sheet reaching the transporting roller pair disposed downstream in the transportation direction, the upwards cockles collapse and are divided on either side of the rotating members (wave holding spurs) and transporting roller pair. Dividing one crest into two reduces the P-P, so off-target landing of ink droplets can be minimized, and contact with the recording head can also be prevented.

According to a second aspect of the present invention, a recording apparatus comprises transporting means for transporting recording sheets in a transportation direction: a platen positioned facing a recording head which records on the recording sheets, comprising groups of ridges extending in the transportation direction, the groups including at least a first ridge group comprising first ridges of a greatest height, and a second ridge group comprising second ridges of heights lower than the first ridges, the second ridge group including ridges of one or more height types; and rotating members disposed downstream in the transportation direction from the recording head, and pressed against ridges of at least one type of the second ridge group.

The recording apparatus may further comprise additional rotating members disposed downstream in the transportation direction from the recording head, and pressed against a position facing the first ridges. The offset between the first ridges and the second ridges against which the rotating members are pressed against is preferably 0.5 mm or less, and this value is preferably determined by the P-P value at the recording area of the wave shape provided upstream in the transportation direction.

Further, the portions of at least one of the first ridges with the greatest height, and the plurality of second ridges which are lower than the first ridges against which the rotating members are pressed, may be formed of roller members rotatably supported by the platen, with the upper face of the perimeter of each roller member having generally the same height as the portion of the platen upstream thereto with respect to the transportation direction.

According to the second aspect of the present invention, rotating members which are equivalent to the wave shape holding spurs in the conventional example are disposed so as to be rotatably pressed against at least one type of the plurality of second ridges of the platen, whereby the height of the rotating members is determined in a sure manner, and further the depth of the troughs of the wave shapes of the recording sheets is determined by the grooves, so the head-sheet distance can be maintained in a stable manner over the entire length of the recording sheet, from the leading edge to the trailing edge.

Also, in the event that a high-concentration recording image has been recorded, the wave shapes are provided beforehand wherein the ridges of the platen forms crests and the at least one type of the plurality of second ridges against which the rotating members are pressed form troughs, so the amplitude of the wave shapes grows. Although how far down the troughs can go is determined by the second ridges of the platen, the swelling of the recording sheet grows as cockling between the ridges, and the swelling of the recording sheet which cannot be absorbed here spills over to the crest of the waves at the highest ridges and grows into cockling which rises up somewhat toward the side of the recording head. Upon the leading edge of the recording sheet reaching the transporting roller pair disposed downstream in the transportation direction, the upwards cockles collapse and are divided on either side of the rotating members (wave holding spurs) and transporting roller pair. Dividing one crest into two reduces the P-P, so off-target landing of ink droplets can be minimized, and contact with the recording head can also be prevented.

According to a third aspect of the present invention, a recording apparatus comprises transporting means for transporting recording sheets in a transportation direction; a platen positioned facing a recording head which records on the recording sheets, comprising a plurality of grooves and ridges extending in the transportation direction; and first rotating members disposed downstream in the transportation direction from the recording head so as to face the grooves, and supported so as to be elastically movable in at least directions toward and away from the recording sheets, wherein slits are formed in the grooves where the first rotating members face, such that the first rotating members do not come into contact with the grooves, and wherein, in a state that no recording sheet is present at the positions wherein the first rotating members face the slits, lower faces of perimeters of the first rotating members are generally the same height as the grooves, or within the slits.

The recording apparatus may further comprise second rotating members disposed downstream in the transportation direction from the recording head so as to face the plurality of ridges of the platen, and supported so as to be elastically movable in at least directions toward and away from the recording sheets, with second slits formed in the ridge portions where the second rotating members face, such that the second rotating members do not come into contact with the ridges, and in the state that no recording sheet is present at the positions wherein the second rotating members face the second slits, the lower face of the perimeter of the second rotating members may be generally the same height as the ridges, or within the second slits.

Further, the offset between the ridges at the positions where the second rotating members are disposed and the grooves where the slits are formed may be 0.5 mm or less, and transporting means disposed downstream in the transportation direction from the recording head may comprise a transporting roller pair generally downstream in the transportation direction from the ridges, for nipping and transporting the recording sheets.

According to a fourth aspect of the present invention, a recording apparatus comprises transporting means for transporting recording sheets in a transporting direction; a platen positioned facing a recording head which records on the recording sheet, comprising groups of ridges extending in the transportation direction, the groups including at least a first ridge group comprising first ridges of a greatest height, and a second ridge group comprising second ridges of height lower than the first ridges, the second group including ridges of one or more height types; and first rotating members disposed downstream in the transportation direction from the recording head, and facing ridges of at least one type of the second ridge group, and supported so as to be elastically movable in at least a direction toward and away from the recording sheets, wherein slits are formed in the second ridges where the first rotating members face, such that the first rotating members do not come into contact with the second ridges, and wherein, in a state that no recording sheet is present at the positions wherein the first rotating members face the slits, lower faces of perimeters of the first rotating members are generally the same height as the second ridges faced thereby, or within the slits.

Also, the recording apparatus may further comprise second rotating members disposed downstream in the transportation direction from the recording head so as to face the first ridges, and supported so as to be elastically movable in at least directions toward and away from the recording sheets, with second slits formed in the first ridges where the second rotating members face, such that the second rotating members do not come into contact with the first ridges, and such that in a state that no recording sheet is present at the positions wherein the second rotating members face the second slits, lower faces of perimeters of the second rotating members are generally the same height as the first ridges, or within the second slits.

Further, the offset between the first ridges where the second rotating member is disposed and corresponding ridges of the second ridges where the slit is disposed is preferably 0.5 mm or less. The recording apparatus may also further comprise roller members rotatably supported by the platen, the roller members having groove-shaped slits facing the first and second rotating members, with the portions on either side of the grooves of the roller members having generally the same height as the portion of the platen upstream thereto.

The recording apparatus may further comprise transporting means disposed downstream in the transportation direction from the recording head may and comprising a transporting roller pair generally downstream in the transportation direction from the first ridges; for nipping and transporting the recording sheets.

The third and fourth aspects of the present invention are particularly advantageous in that advantages similar to those of the first and second aspects can be realized, and further, the rotating members do not come into contact with the platen in a state wherein no recording sheet is present, so even in the event of using spurs having multiple protrusions on the perimeter thereof as the rotating members, the spurs are not damaged. The slits here are just wide enough to avoid contact between the platen and the rotating members, and not wide enough for the recording sheets to be pressed into the slits.

Further objects, features and advantages of the present invention will become apparent from the following description of the preferred embodiments with reference to the attached drawings.

DESCRIPTION OF THE PREFERRED EMBODIMENTS

First Embodiment

Figure 1:
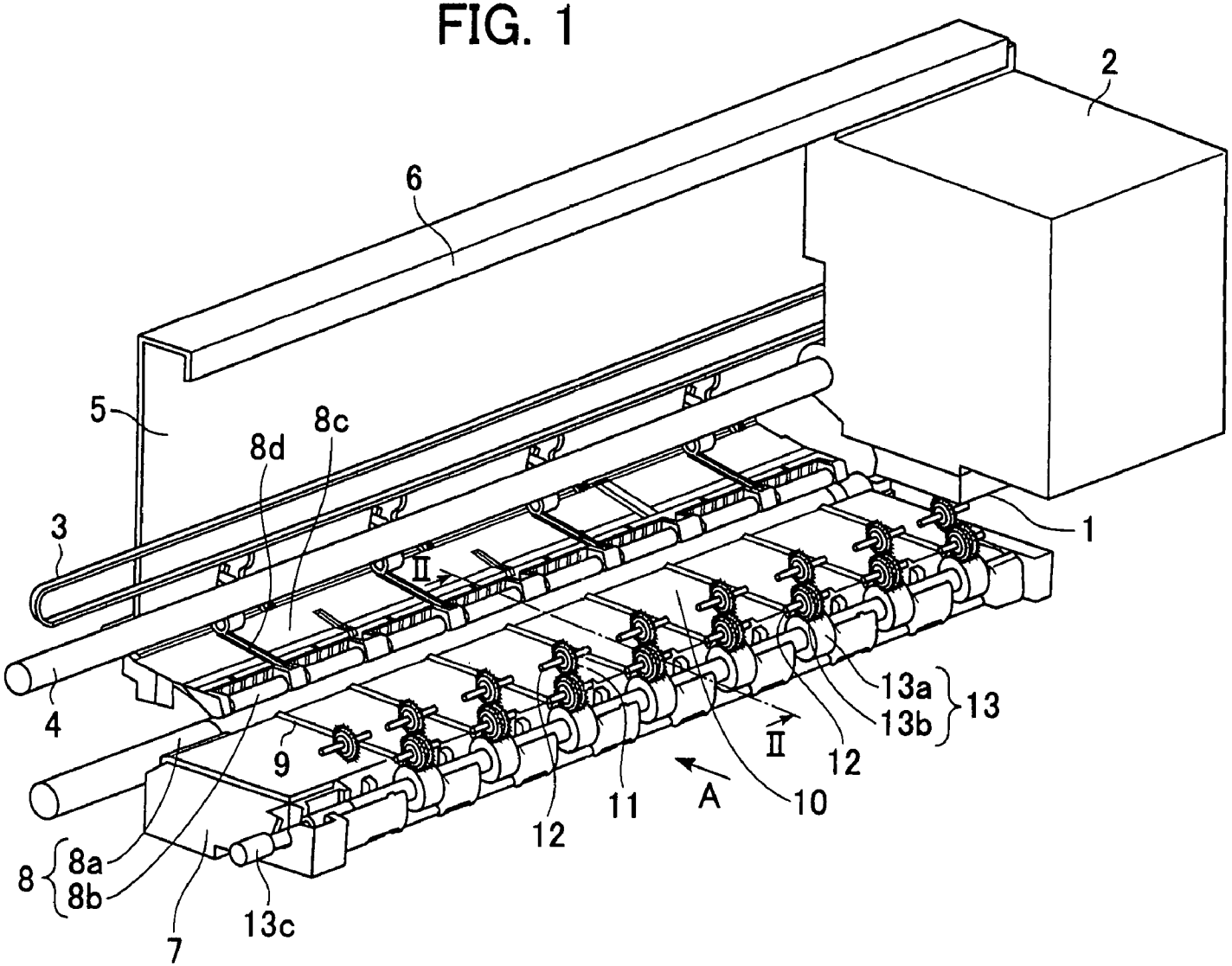
FIG. 1 is a perspective view of a recording apparatus according to a first embodiment of the present invention.
Figure 2:
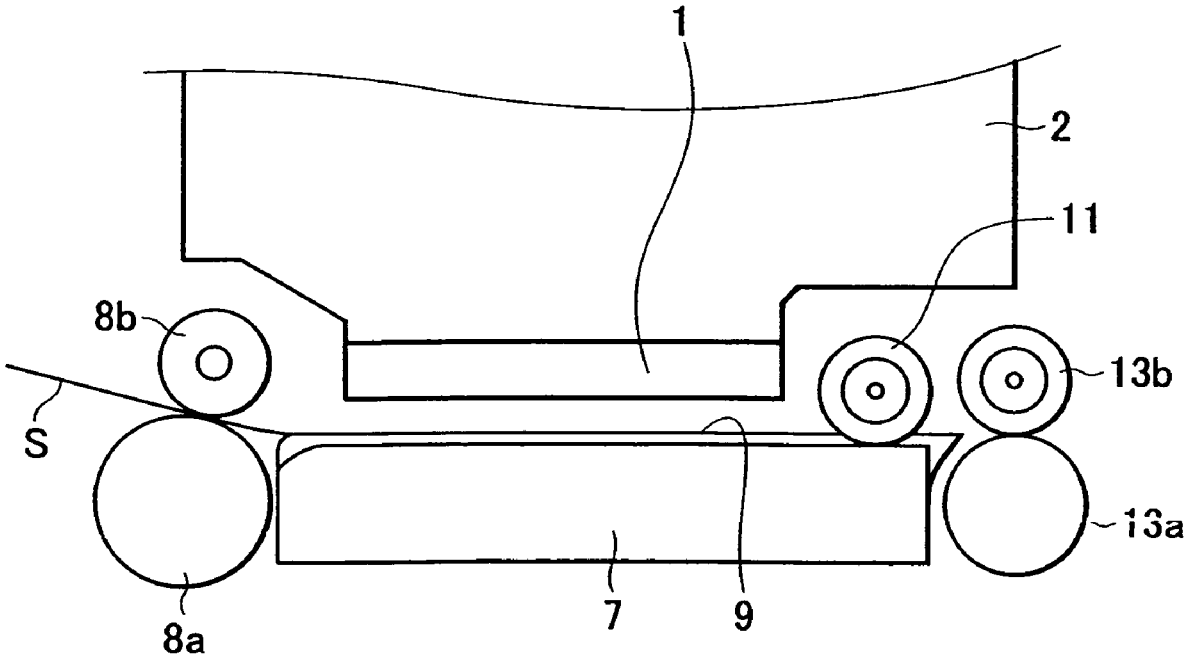
FIG. 2 is a cross-section of the recording apparatus shown in FIG. 1 along line II-II.

A recording apparatus according to a first embodiment of the present invention will now be described with reference to the drawings. FIG. 1 is a perspective view of the recording apparatus according to the present invention with a portion around the platen cut away, and FIG. 2 is a cross-section of that shown in FIG. 1 along line II-II.

In FIG. 1, a recording head 1 is mounted on a carriage 2, and the carriage 2 is driven by a carriage motor (not shown in the drawings) through a timing belt 3, so as to reciprocally scan over a platen 7 while supported by a guide rail 4 and a supporting rail 6 provided on a chassis 5.

A recording sheet S is transported to a nip position between a transporting roller pair 8 of a transporting roller 8*a* and a pinch roller 8*b*, where skewing and the like is corrected. This pinch roller 8*b* is under force of a pinch roller spring 8*d* through a pinch roller holder 8*c* so as to be pressed against the transporting roller 8*a*. Thus the pinch roller 8*b* follows the rotations of the transporting roller 8*a*, and accordingly the transporting roller pair 8 can nip and transport the recording sheet S. The pinch roller 8*b* is pressed against the transporting roller 8*a* at a position such that the pinch roller 8*b* is offset in the downstream direction of transportation from the transporting roller 8*a*, and the nipping position of the transporting roller pair 8 is above the platen 7, so the recording sheet S is transported so as to be pressed against the platen 7 from diagonally above.

Multiple ridges 9 and grooves 10 are alternately provided on the transportation face of the platen 7 extending in the direction of sheet transportation, at 20 to 40 mm intervals. Accordingly, upon the recording sheet S being pressed against the platen 7 by the transporting roller pair 8, the portions at the ridges 9 become crests and the portions at the grooves 10 become troughs, thereby providing a wave shape to the recording sheet S. The difference in height between the ridges 9 and the grooves 10 is preferably 0.5 mm or less, and this value is preferably set to the aforementioned P-P (peak-to-peak value) or lower at the recording area of the recording apparatus, more specifically at the recording range of the recording head 1.

Also, wave holding spurs 11 are disposed at the grooves 10 downstream from the recording area, configured so as to be rotatably supported at the center of rotation thereof by torsion coil springs 12 and also pressed against bottom surfaces of the grooves 10. Thus, upon the leading edge of the recording sheet S reaching the wave holding spurs 11, the wave holding spurs 11 rotate in accordance with this movement and also move upwards by a distance corresponding to the thickness of the recording sheet S, thereby guiding the recording sheet S between the wave holding spurs 11 and the grooves 10. Note that the term "spur" refers to a disc-shaped object with multiple sharp protrusions provided on the perimeter thereof, so as to come into contact with the recording face of the recording sheet S by the minute surface area of the protrusions, thereby aiding transportation of the recording sheet S without disturbing images recorded thereupon in the event that there is any unfixed ink on the recording face of the recording sheet S. In the event that fast-fixing ink is to be used, the wave holding spurs 11 do not need to be spurs, and may be simple molded disc shapes instead.

Also, sheet discharge roller pairs 13, each made up of a sheet discharge roller 13*a* and a transportation spur 13*b*, are provided downstream of the ridges 9. The sheet discharge rollers 13*a* are formed of an elastic material such as rubber or the like, with a sheet discharge roller shaft 13*c* disposed therein. The transporting spurs 13*b* are rotatably supported on the center of rotation thereof by torsion coil springs 12, and pressed against the discharge rollers 13*a*. The transporting spurs 13*b* thus follow the rotations of the sheet discharge rollers 13*a*, such that the sheet discharge roller pairs 13 nip and transport the recording sheet S.

The recording sheet S upon which recording has been completed with the recording apparatus having such a configuration is then discharged to an unshown discharge tray.

Figure 3A:
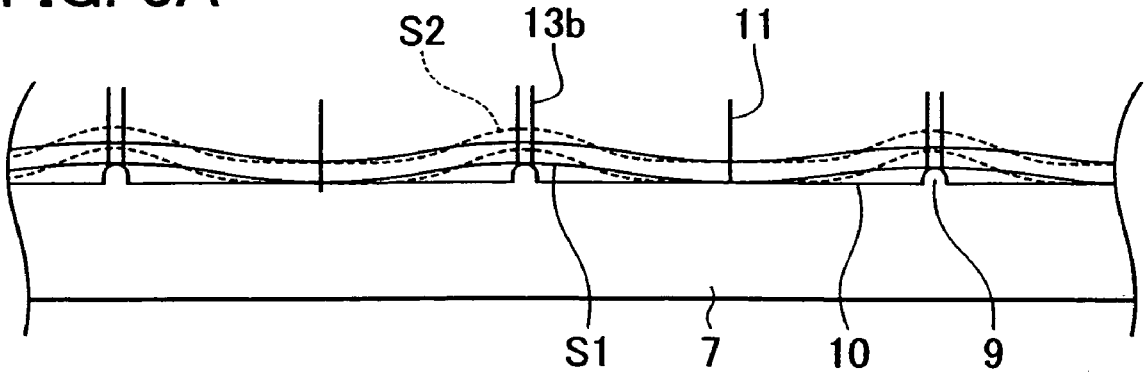
FIGS. 3A through 3D are views of the recording apparatus shown in FIG. 1 from the direction of the arrow A, describing the behavior of recording sheets.
Figure 3B:
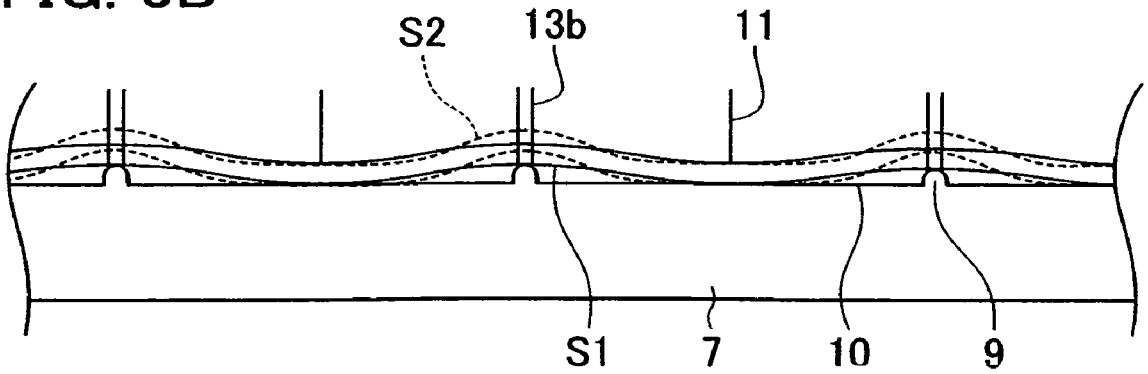
Figure 3C:
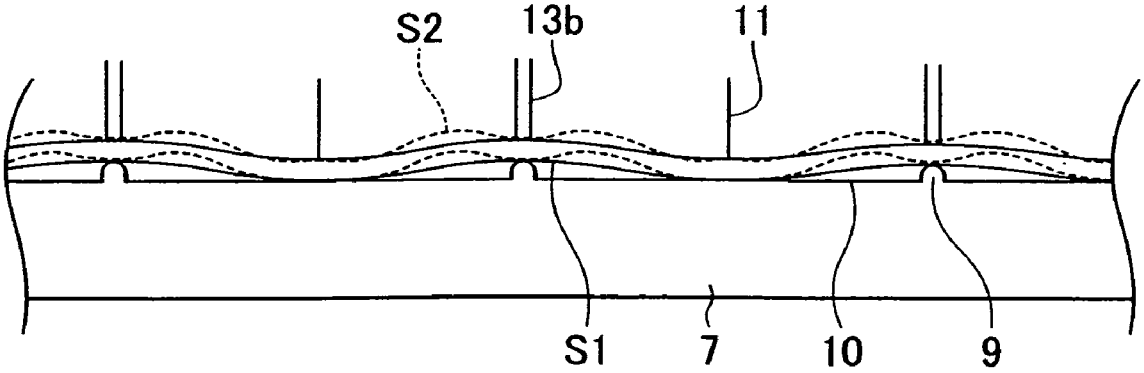
Figure 3D:
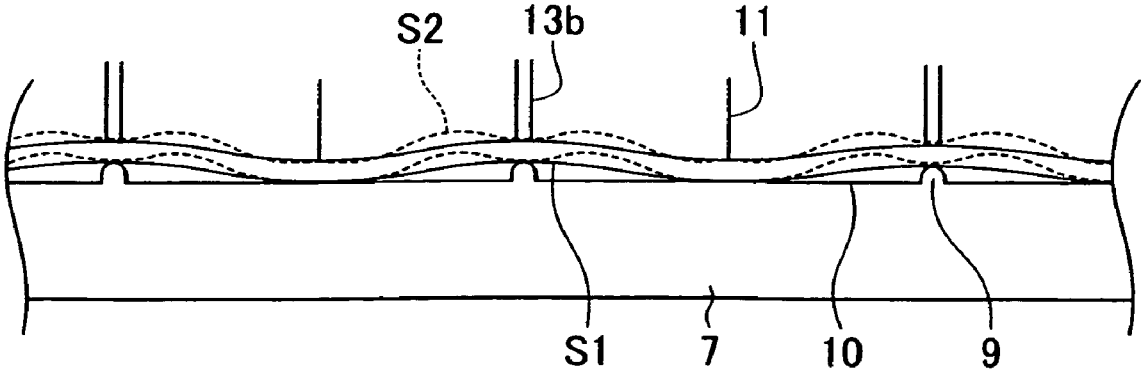

Next, the behavior of a recording sheet S upon which a high-concentration image has been recorded will be described with reference to FIGS. 3A through 3D. These drawings are the recording apparatus shown in FIG. 1 viewed from the direction of the arrow A, wherein FIG. 3A illustrates a state before the leading edge of the recording sheet S reaches the wave holding spurs 11, FIG. 3B illustrates a state wherein the leading edge of the recording sheet S has passed beyond the wave holding spurs 11, FIG. 3C illustrates a state wherein the leading edge of the recording sheet S has passed through the sheet discharge roller pairs 13, and FIG. 3D illustrates a state wherein the trailing edge of the recording sheet S has passed through the transportation roller pair 8. Also, the solid line S1 representing the recording sheet S in each of the drawings is to be understood to be a recording sheet upon which either nothing has been recorded, i.e., an unrecorded sheet, or a low concentration image has been recorded, and the dotted line S2 represents the recording sheet upon which a high-concentration image has been recorded, such that the recording sheet S has become swelled and cockling has occurred.

First, description will be made regarding the recording sheet in an unrecorded state indicated by the solid line S1 in FIGS. 3A through 3D, meaning that either nothing or a low concentration image has been recorded thereon, and accordingly there is hardly any swelling.

First, the behavior before the leading edge of the recording sheet reaches the wave holding spurs 11 will be described. The recording sheet S1 is transported by the transporting roller pair 8 so as to be pressed against the platen 7, so as to be provided with the wave shapes with crests at the ridges 9 and troughs at the grooves 10. In the recording area, the offset between the ridges 9 and the grooves 10 is set to the aforementioned P-P or lower, so the non-recording face of the recording sheet S1 at the troughs comes into contact with the grooves 10. Also, the crests are pressed against the ridges 9 by the transporting roller pair 8, so the non-recording face is pressed against the ridges 9 in the same way (the state in FIG. 3A). Next, the state wherein the leading edge of the recording sheet S1 has passed beyond the wave holding spurs 11 will be described. The wave holding spurs 11 are disposed pressed against the grooves 10 beforehand, and accordingly only move upwards by the thickness of the recording sheet S1 upon conveyance of the recording sheet S1 thereby, so there is no change in the attitude of the recording sheet S1 or head-sheet distance (the state in FIG. 3B). Next, the state wherein the leading edge of the recording sheet S1 has passed through the sheet discharge roller pairs 13 will be described, though the sheet discharge rollers 13*a* are not shown in FIGS. 3A through 3D. Here, the sheet discharge roller pairs 13 are provided generally downstream of the ridges 9, and the height of the nipping portion is set so as to be generally the same height as that of the ridges 9, so the transporting spurs 13*b* only move upwards by the thickness of the recording sheet S1 upon conveyance of the recording sheet S1 thereby, and there is no change in the attitude of the recording sheet S1 or head-sheet distance (the state in FIG. 3C).

Finally, the state wherein the trailing edge of the recording sheet S has passed through the transporting roller pair 8 will be described. Here, the transporting roller pair 13 does not force the recording sheet S1 against the platen 7 any more, but the crest portions of the recording sheet S1 are held by the sheet discharge roller pairs 13 and the troughs are pressed against the grooves 10 by the wave holding spurs 11, so there is no change in the attitude of the recording sheet S1 or head-sheet distance. Also, with the present embodiment, the wave holding spurs 11 are disposed upstream in the sheet transportation direction from the sheet discharge roller pairs 13, so even in the event that the leading edge portion of the recording sheet S1 which has passed through the sheet discharge roller pairs 13 bends downwards due to its own weight, the trailing edge of the recording sheet S1 does not rise up (the state in FIG. 3D). As described above, with the present invention, with either an unrecorded sheet, or a sheet upon which a low concentration image has been recorded, so there is hardly any swelling of the recording sheet the shape of the waves and the head-sheet distance is unchanged from the leading edge to the trailing edge of the recording sheet, so off-target landing of ink droplets can be prevented.

Also, with regard to curling of the recording sheets due to environmental conditions, the wave shapes are provided upstream of the recording area, and also the wave shapes are maintained by the wave holding spurs 11 following the trailing edge passing through the sheet discharge roller pairs 13. This increases the rigidity of the recording sheet S1 so that curling is corrected, and floating up toward the side of the recording head 1 is prevented.

Next, description will be made regarding the recording sheet in a state indicated by the broken line S2 in FIGS. 3A through 3D, wherein a high-concentration recording image has been recorded on the recording sheet and cockling has occurred.

First, the behavior before the leading edge of the recording sheet reaches the wave holding spurs 11 will be described. In the event that a high-concentration recording image has been recorded, wave shapes have been provided wherein crests are formed at the ridges of the platen 7, and troughs at the grooves, so basically, the recording sheet S2 tries to absorb the swelling by increasing the amplitude of the waves. However, the magnitude of the trough is determined by the groove 10, so the bottom of the trough absorbs the swelling by spreading sideways, and the swelling of the recording sheet S2 which cannot be absorbed here spills over to the crest of the waves, and grows into cockling which rises up somewhat toward the side of the recording head 1 (the state in FIG. 3A).

Now, with conventional examples, the troughs were not supported from below, so the swelling of the recording sheet S2 was almost completely absorbed by the trough going down. Accordingly, there was hardly any rising of the crest toward the recording head 1, but as a result, the head-sheet distance of areas to be recorded also widened. Conversely, with the present embodiment, the head-sheet distance does not widen, and the crests rise up somewhat toward the side of the recording head 1, but not enough to come into contact with the recording head 1, since a good deal of the swelling of the recording sheet S2 has already been absorbed at the troughs.

Next, the state wherein the leading edge of the recording sheet has passed the wave holding spurs 11 will be described. The wave holding spurs 11 are disposed pressed against the grooves 10 beforehand, and accordingly only move upwards by the thickness of the recording sheet S2 upon the recording sheet S2 being transported past, so there is no change in the state of the recording sheet S2 from the state in FIG. 3A (the state in FIG. 3B).

Next, the state wherein the leading edge of the recording sheet S2 has reached the sheet discharge roller pairs 13 will be described. The nip height of the sheet discharge roller pairs 13 is set so as to be generally the same height as the ridges 9, so in the event that an upwards cockle reaches a sheet discharge roller pair 13 in a state of floating above a ridge 9, this upwards cockle collapses and is divided on either side of the transporting spur 13*b*, i.e., between the transporting spur 13*b* and the wave holding spurs 11 on either side. Dividing one crest into two thus further reduces the P-P as compared with the conventional examples (the state in FIG. 3C).

Finally, the state wherein the trailing edge of the recording sheet S2 has passed the transporting roller pair 8 will be described. As described above, the trailing edge of the recording sheet S2 does not rise due to the leading edge of the recording sheet S2 bending down, and so the state of the recording sheet S2 is the same as that shown in FIG. 3C (the state in FIG. 3D).

As described above, with the present invention, even in the event that a high-concentration image is recorded and cockling occurs, the troughs of the cockling do not exceed the predetermined magnitude, the swelling is absorbed by the bottom of the trough spreading, and the swelling that cannot be absorbed there spills over to the crest of the waves and grows into cockling which rises up somewhat toward the side of the recording head 1, but not enough to come into contact with the recording head 1, since a good deal of the swelling of the recording sheet S2 has already been absorbed at the trough area, so the P-P can be suppressed as well. Also, following the leading edge of the recording sheet S2 passing the sheet discharge roller pairs 13, the number of crests of the cockles is doubled, further suppressing the P-P. Accordingly, off-target landing of ink droplets can be minimized, and contact with the recording head can also be prevented.

Now, a supplementary explanation must be given here. The greater the number of crests, the lower the P-P, which is the amplitude of swelling of the recording sheet, can be kept. Accordingly, it might seem that the problem could be circumvented by providing a greater number of crests to begin with, since the apparatus is arranged to provide wave shapes anyway. However, in order to provide wave shapes to an initially-flat recording sheet, the pitch of the crests must be around 20 to 40 mm. Attempting to increase the number of crests disregarding this fact results in intended troughs turning into crests, and adjacent crests joining into a single crests, resulting in the sheet rising up toward the recording head. The reason that the present invention succeeds in doubling the number of cockles is because each crest on a recording sheet, of which the rigidity has weakened somewhat, is divided into two crests by the transporting spurs 13*b*.

The recording apparatus will now be described with reference to other embodiments. The recording apparatus in the following embodiments is basically the same as that in the first embodiment, so only the points differing from the first embodiment will be described, and parts which are the same or equivalent will be denoted with the same reference numerals.

Second Embodiment

Figure 4:
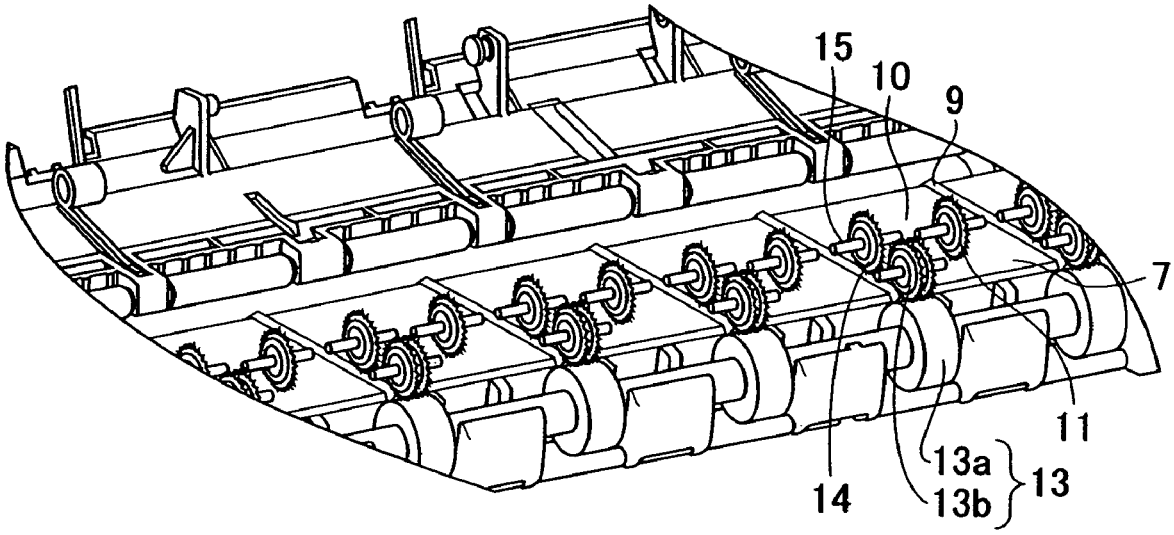
FIG. 4 is a perspective view of a recording apparatus according to a second embodiment of the present invention.

While the first embodiment only had the wave holding spurs 11 pressed against the grooves 10 as spurs disposed above the platen 7, with the present embodiment, ridge spurs 14 are also disposed on the ridges 9 in addition to the wave holding spurs 11 as shown in FIG. 4. The ridge spurs 14 are disposed in generally the same position as the wave holding spurs 11 in the direction of transportation, rotatably supported on the center of rotation thereof by torsion coil springs 15, and pressed against the ridges 9. Due to such a configuration, unrecorded recording sheets and recording sheets where little swelling has occurred can be pressed against the ridges 9 in a more sure manner, and sheets with cockling can have the number of crests doubled before reaching the sheet discharge roller pairs 13.

Third Embodiment

Figure 5:
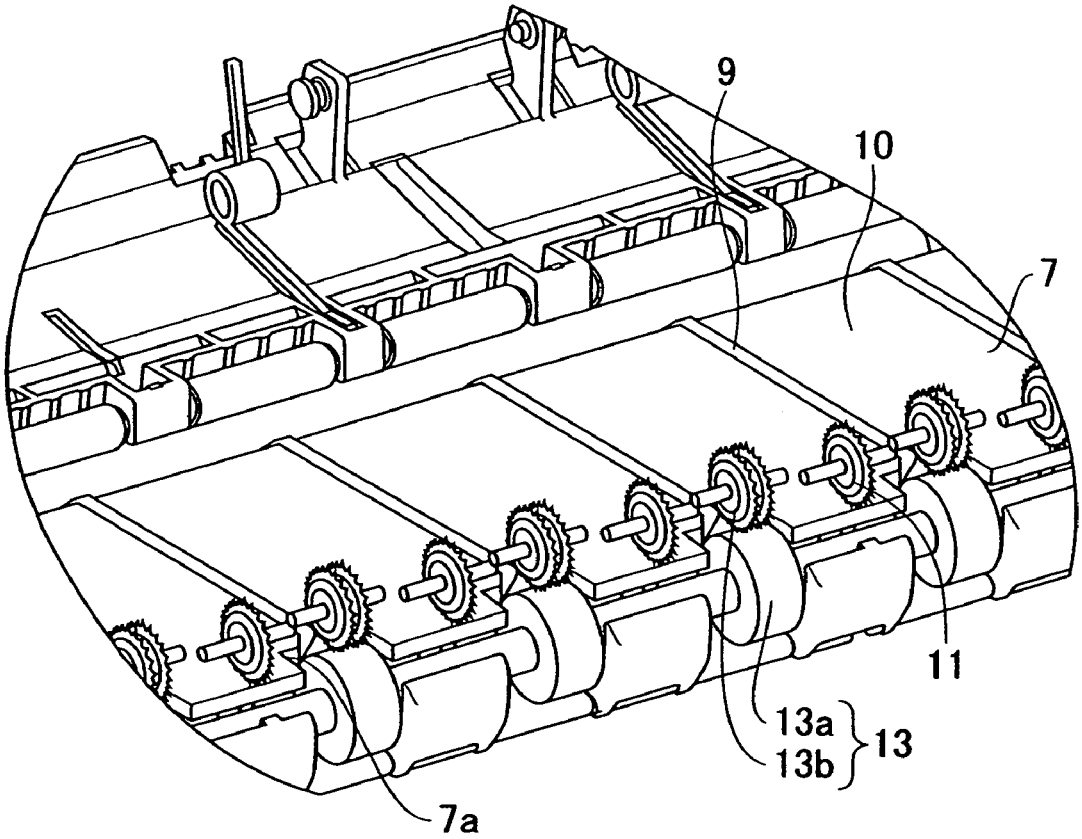
FIG. 5 is a perspective view of a recording apparatus according to a third embodiment of the present invention.

This embodiment has notches 7*a* formed in the platen 7 as shown in FIG. 5, with the sheet discharge roller pairs 13 disposed at the position of the notches 7*a*. Thus, the sheet discharge roller pairs 13 are at generally the same position in the transportation direction as the wave holding spurs 11.

However, in this case, the transporting spurs 13*b* need to be offset upstream in the transportation direction as to the sheet discharge rollers 13*a*, so as to press the trailing edge of the recording sheet in the direction of the platen 7, in order to prevent floating following the trailing edge of the recording sheet passing the transporting roller pair 8. The configuration of the present embodiment allows the depthwise length to be reduced, thereby conserving space.

Fourth Embodiment

Figure 6:
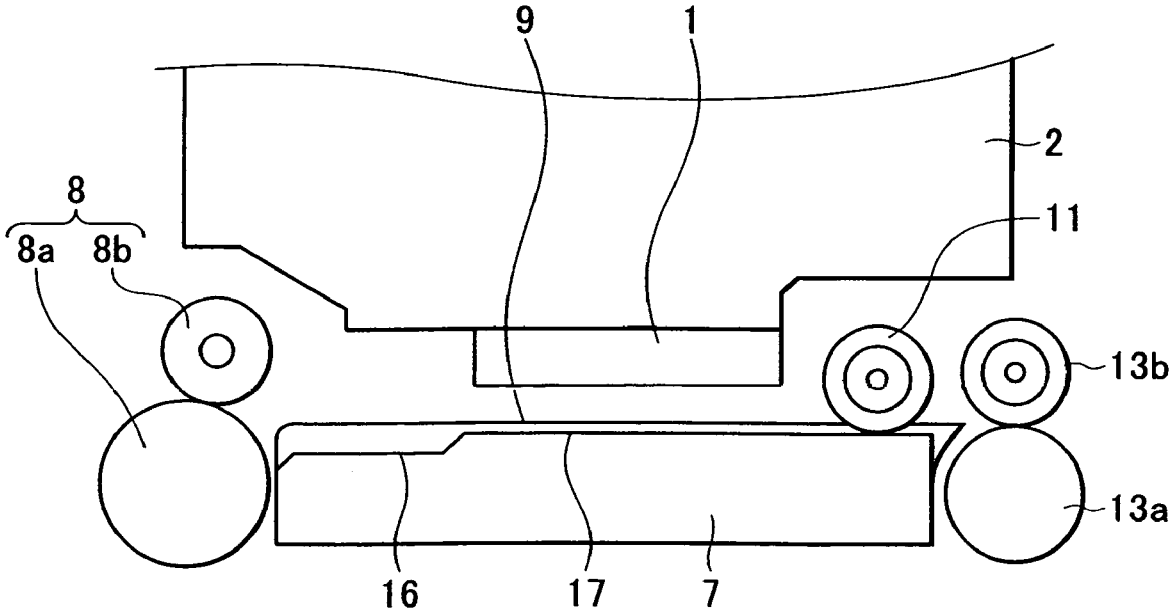
FIG. 6 is a cross-sectional view of a recording apparatus according to a fourth embodiment of the present invention.

While the first embodiment had the depth of the grooves 10 the same all the way from the upstream to the downstream in the transportation direction, with the present embodiment, the grooves are formed deeper upstream, as shown in FIG. 6. That is, first grooves 16 and second grooves 17 are provided on the platen 7. The offset between the second grooves 17 and the ridges 9 is the same as with the other embodiments, and the first grooves 16 are formed deeper than the second grooves 17. Also, the position of the second grooves 17 in the transportation direction is generally directly below the recording position of the recording head 1. According to this configuration of the present embodiment, the amplitude of the wave shapes is greater than the range of the second grooves 17, so the wave shapes can be made to spread to the range of the second grooves 17 in a sure manner, which is particularly effective in the event that the recording position of the recording head 1 is far from the transporting roller pair 8, or in the event that the recording head 1 is long.

Fifth Embodiment

Figure 7:
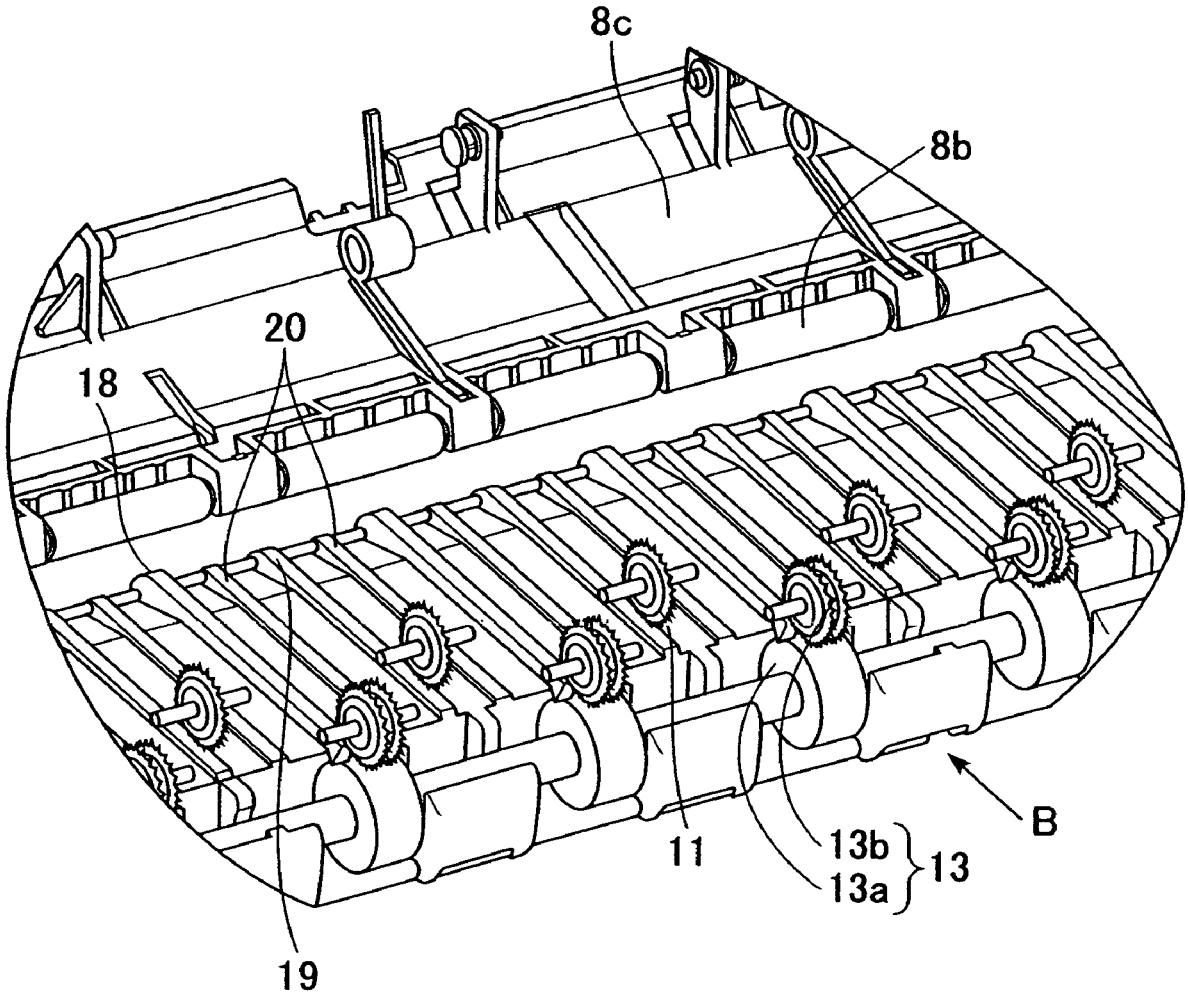
FIG. 7 is a perspective view of a recording apparatus according to a fifth embodiment of the present invention.

While the above embodiments have been described with one type each of ridges and grooves, the recording apparatus according to the present embodiment has three types of ridges with differing heights provided on the platen 7, as shown in FIG. 7.

In FIG. 7, the platen has first ridges 18, second ridges 19, and third ridges 20, each of different heights. Of these, the first ridges 18 are the highest, next the second ridges 19, and the lowest are the third ridges 20. Now, the offset between the first ridges 18 and the second ridges 19 is preferably 0.5 mm or less, with this value being equal to or less than the height where the troughs are located at the recording range of the recording head 1. The third ridges 20 are disposed between the first ridges 18 and the second ridges 19. Also, the wave holding spurs 11 are pressed against the second ridges 19.

Figure 8A:
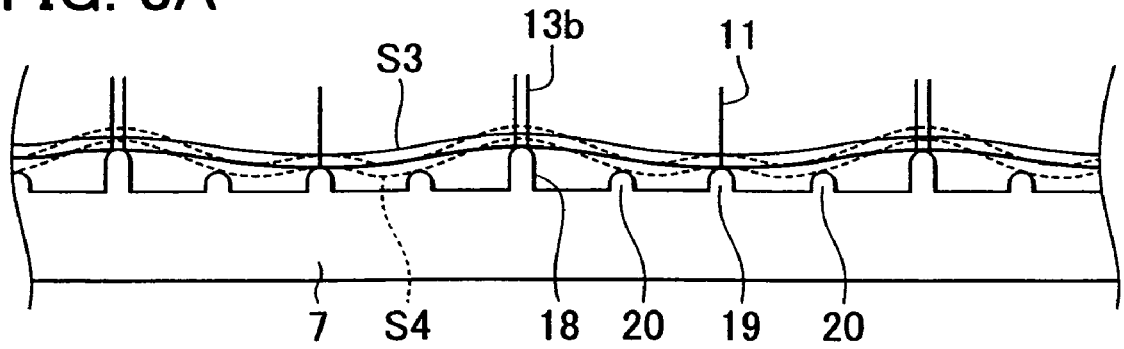
FIGS. 8A through 8D are views of the recording apparatus shown in FIG. 7 from the direction of the arrow B, describing the behavior of recording sheets.
Figure 8B:
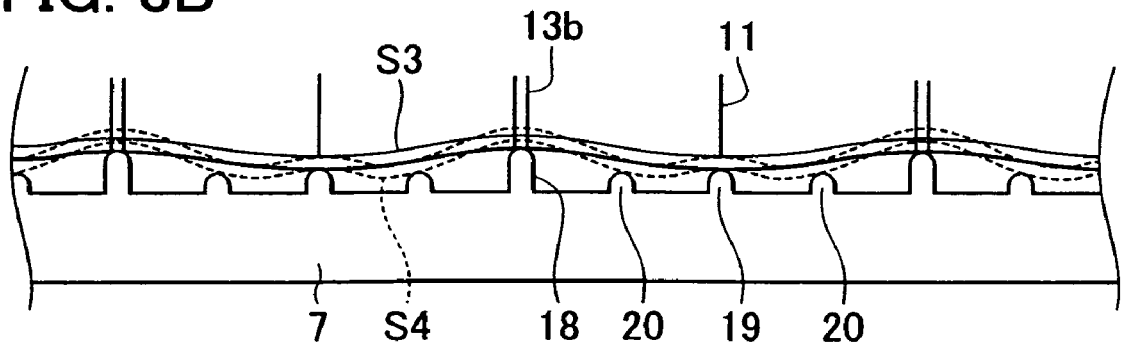
Figure 8C:
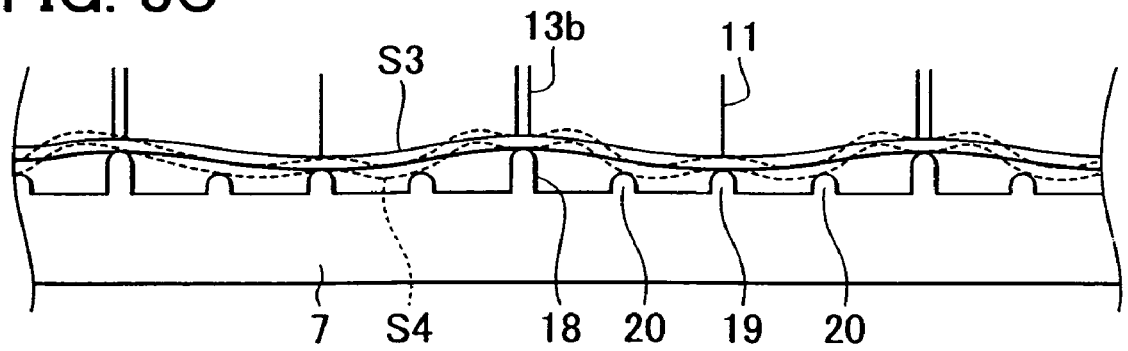
Figure 8D:
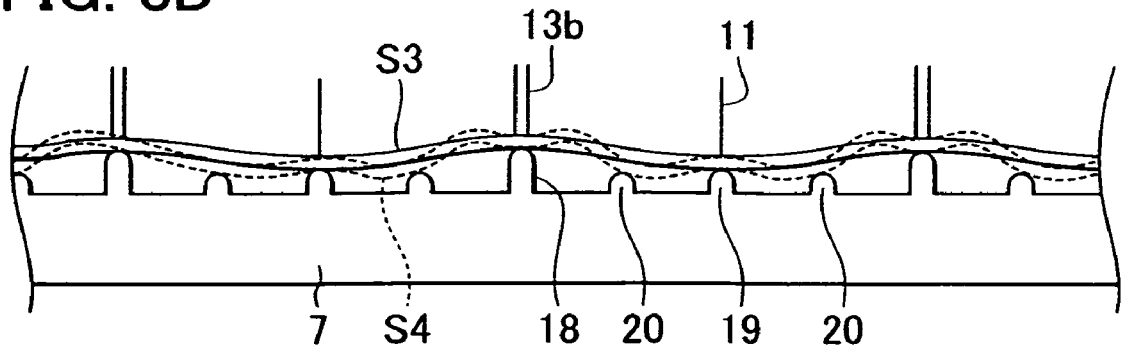

Next, the behavior of a recording sheet S before recording and upon which a high-concentration image has been recorded will be described with reference to FIGS. 8A through 8D. These drawings are the recording apparatus shown in FIG. 7 viewed from the direction of the arrow B, wherein FIG. 8A illustrates a state before the leading edge of the recording sheet S reaches the wave holding spurs 11, FIG. 8B illustrates a state wherein the leading edge of the recording sheet S has passed over the wave holding spurs 11, FIG. 8C illustrates a state wherein the leading edge of the recording sheet S has passed through the sheet discharge roller pairs 13, and FIG. 8D illustrates a state wherein the trailing edge of the recording sheet S has passed through the transportation roller pair 8. Also, the solid line S3 representing the recording sheet S in each of the drawings is to be understood to be a recording sheet upon which either nothing has been recorded, i.e., an unrecorded sheet, or a low concentration image has been recorded, and the dotted line S4 represents the recording sheet upon which a high-concentration image has been recorded, such that the recording sheet S has become swelled and cockling has occurred.

First, description will be made regarding the recording sheet in an unrecorded state indicated by the solid line S3 in FIGS. 8A through 8D, meaning that either nothing or a low concentration image has been recorded thereon, and accordingly there is hardly any swelling. The only difference between this and that shown in FIGS. 3A through 3D with the first embodiment is that the places where the troughs come into contact are the ridges 19 instead of the grooves 10, and there is no difference in the behavior of the recording sheet itself, so further description thereof will be omitted.

Next, description will be made regarding the recording sheet in a state indicated by the broken line S4 in FIGS. 8A through 8D, wherein a high-concentration recording image has been recorded on the recording sheet and cockling has occurred.

First, the behavior before the leading edge of the recording sheet reaches the wave holding spurs 11 will be described. In the event that a high-concentration recording image has been recorded, wave shapes have been provided wherein crests are formed at the first ridges 18 and troughs at the second ridges 19, so basically, the recording sheet S4 tries to absorb the swelling by increasing the amplitude of the waves. However, the magnitude of the trough is determined by the second ridges 19; so the bottom of the trough absorbs the swelling by being divided between the second ridges 19 and the third ridges 20. The swelling of the recording sheet S4 which cannot be absorbed here spills over to the crest of the waves, and the crests rise up somewhat toward the side of the recording head 1, but not as much as with the first embodiment, since the amount absorbed at the troughs is that much greater (the state in FIG. 8A).

Next, the behavior of the wave holding spurs 11 in the state wherein the leading edge of the recording sheet has passed the wave holding spurs 11 is the same as that in the first embodiment, and the state of the recording sheet S4 is unchanged from the state in FIG. 8A (the state in FIG. 8B).

Next, the state wherein the leading edge of the recording sheet S4 has reached the sheet discharge roller pairs 13 will be described. The nip height of the sheet discharge roller pairs 13 is set so as to be generally the same height as the first ridges 18, so in the event that an upwards cockle reaches a sheet discharge roller pair 13 in a state of floating above a ridge 18, this upwards cockle collapses and is divided on either side of the transporting spur 13*b*, i.e., between the transporting spur 13*b* and the wave holding spurs 11 on either side. Dividing one crest into two thus further reduces the P-P as compared with the conventional examples (the state in FIG. 8C).

Finally, the state wherein the trailing edge of the recording sheet S4 has passed the transporting roller pair 8 will be described. As described above, the trailing edge of the recording sheet S4 does not rise due to the leading edge of the recording sheet S4 bending down, and so the state of the recording sheet S4 is the same as that shown in FIG. 8C (the state in FIG. 8D).

As described above, with the present embodiment, the amount of rising toward the recording head 1 can be reduced in the state wherein cockling has occurred, before reaching the wave holding spurs 11. However, the head-sheet distance increases somewhat at the grooves, so this is suitable for apparatuses designed mainly to record on film recording sheets which do not readily exhibit cockling. In this case, the distance between the recording head 1 and the ridges 18 can be reduced as much as possible to obtain high-quality images, and while the sheet-head distance increases somewhat at the grooves for rare cases of recording sheets which readily exhibit cockling, contact with the recording head 1 can be prevented.

Now, with the present embodiment, only the wave holding spurs 11 were described as being pressed against the ridges 19 as spurs disposed above the platen 7, but ridge spurs 14 may also be disposed against the first ridges 18 as with the second embodiment, or the sheet discharge roller pairs 13 may be disposed at generally the same position as the wave holding spurs 11 as with the third embodiment. Further, the upstream side of the second and third ridges 19 and 20 may be formed one step lower as with the fourth embodiment. Further, the number of types of ridges has been described as three in the present embodiment, but the present invention is not restricted to this arrangement, and two or more types are suitably used.

Sixth Embodiment

Figure 9:
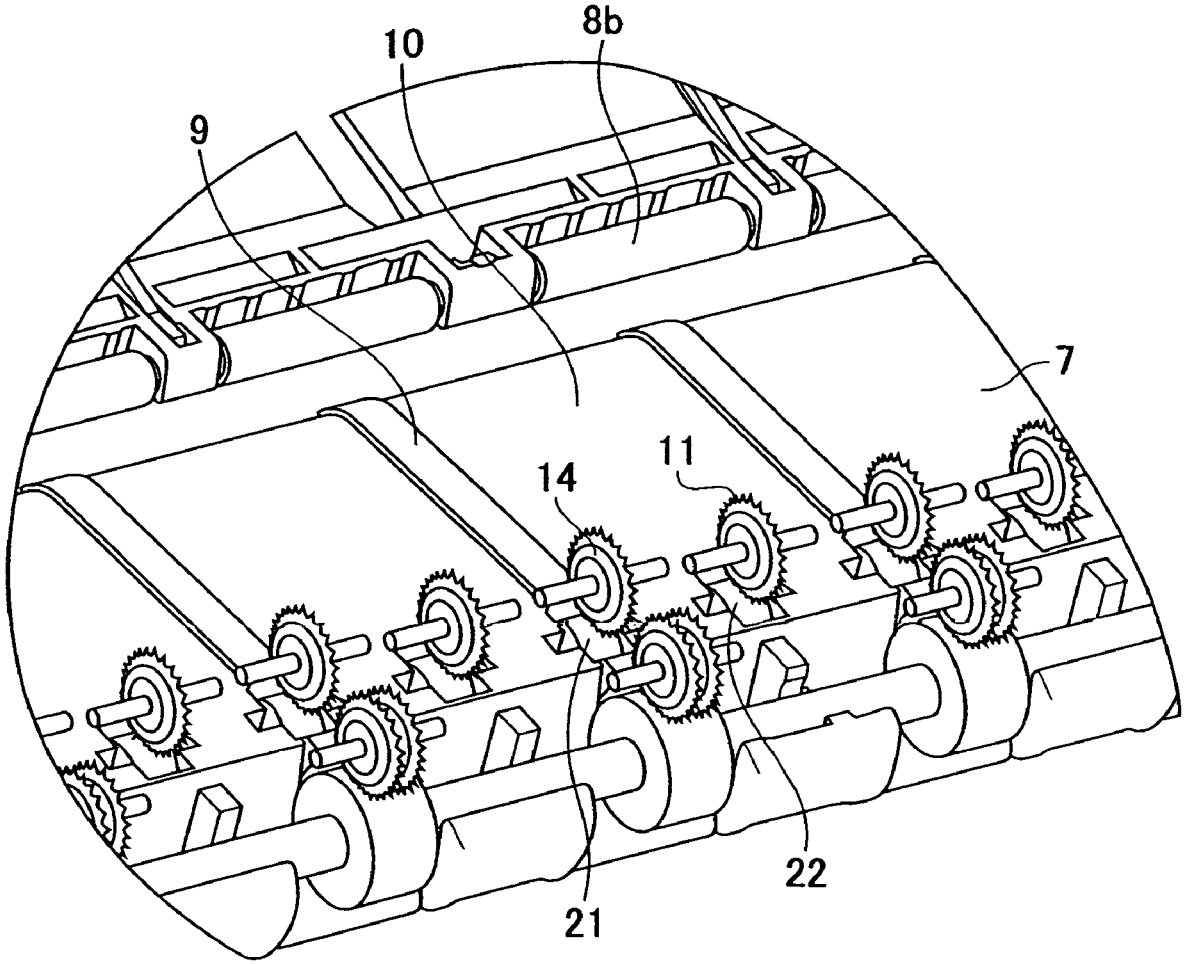
FIG. 9 is a perspective view of a recording apparatus according to a sixth embodiment of the present invention.

While the above-described embodiments had the wave holding spurs 11 and the ridge spurs 14 pressed directly against the grooves and ridges on the platen 7, the recording apparatus according to the present embodiment has a configuration wherein rotatable rollers are provided on the platen 7, as shown in FIG. 9.

In FIG. 9, the ridge rollers 21 are provided downstream of the recording area on the platen 7 in a rotatable manner such that the upper face of the perimeter thereof is generally the same height as the ridges 9, and also groove rollers 22 are provided downstream of the recording area on the platen 7 in a rotatable manner such that the upper face of the perimeter thereof is generally the same height as the grooves 10. Ridge spurs 14 are pressed against the ridge rollers 21, and wave holding spurs 11 are pressed against the groove rollers 22.

With such a configuration, the recording sheet S is nipped between the ridge spurs 14 and the rotatable ridge rollers 21, and between the wave holding spurs 11 and the rotatable groove rollers 22, so the transportation resistance of the recording sheet S is reduced. Also, the ridge rollers 21 and the groove rollers 22 are directly built into the platen 7, so the perimeter faces thereof can be easily made to match the general height of the ridges 9 and the grooves 10. Accordingly, the other advantages thereof are the same as those obtained with the second embodiment.

Seventh Embodiment

Figure 10:
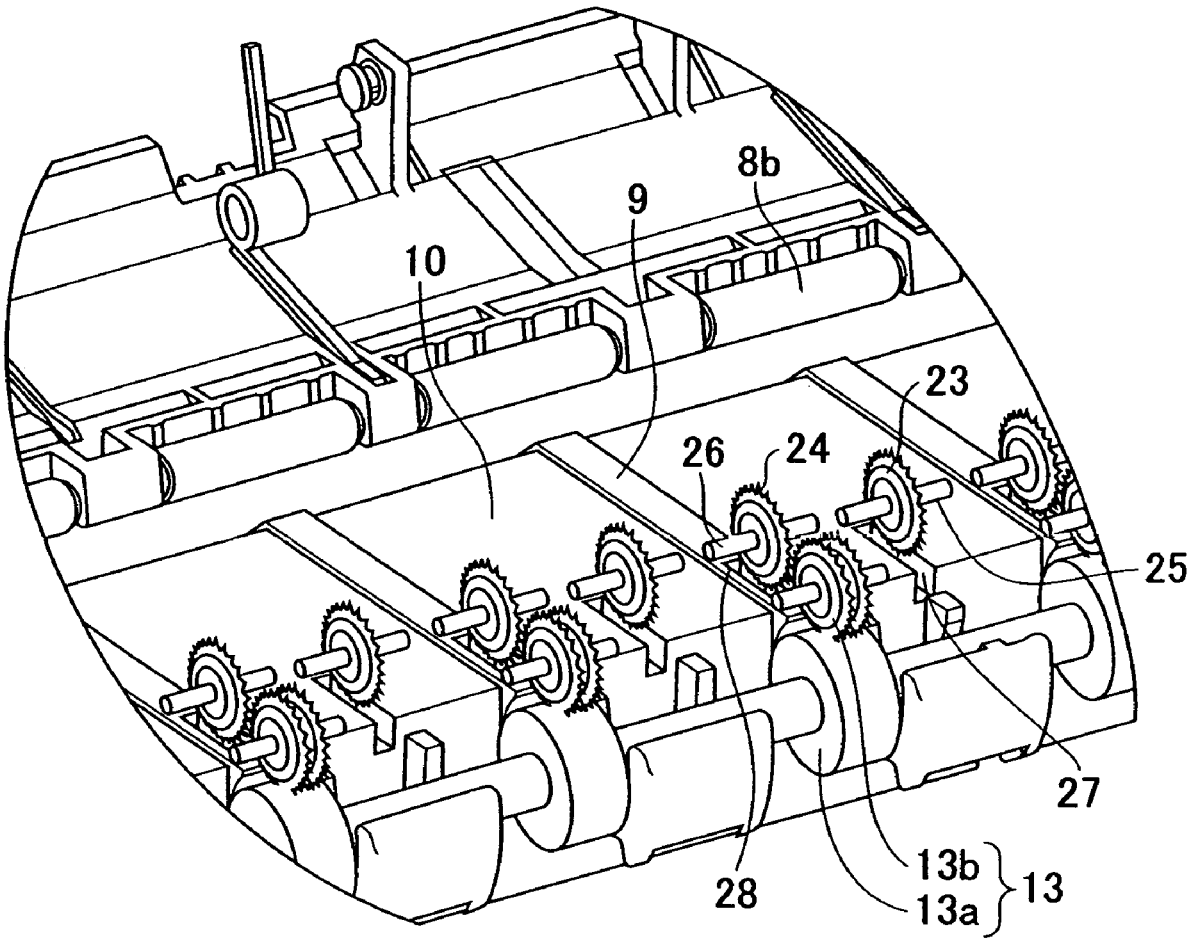
FIG. 10 is a perspective view of a recording apparatus according to a seventh embodiment of the present invention.
Figure 11:
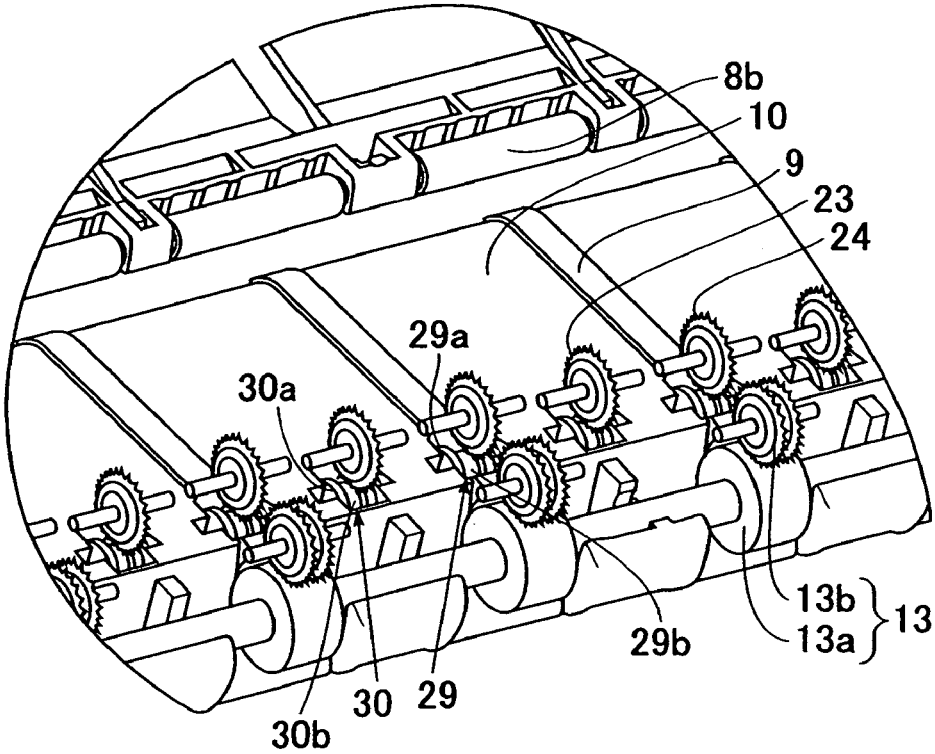
FIG. 11 is a perspective view of a recording apparatus according to an eighth embodiment of the present invention.
Figure 12:
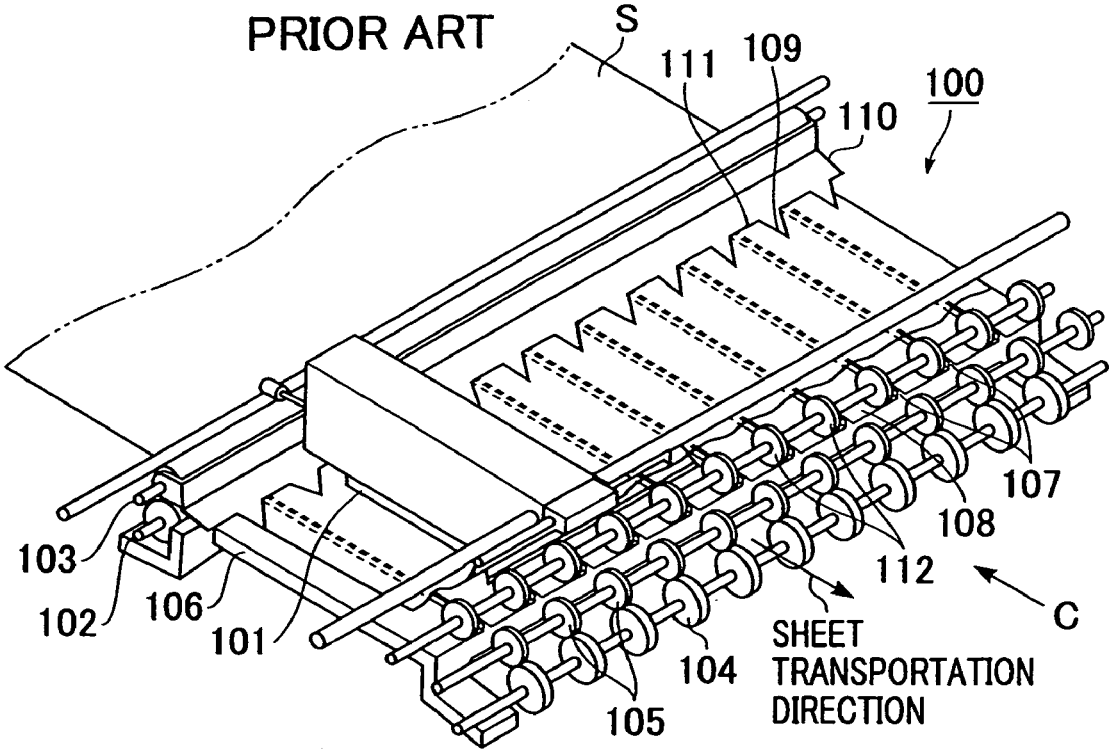
FIG. 12 PRIOR ART
FIG. 12 is a perspective view of a recording apparatus according to a first conventional example.
Figure 13:
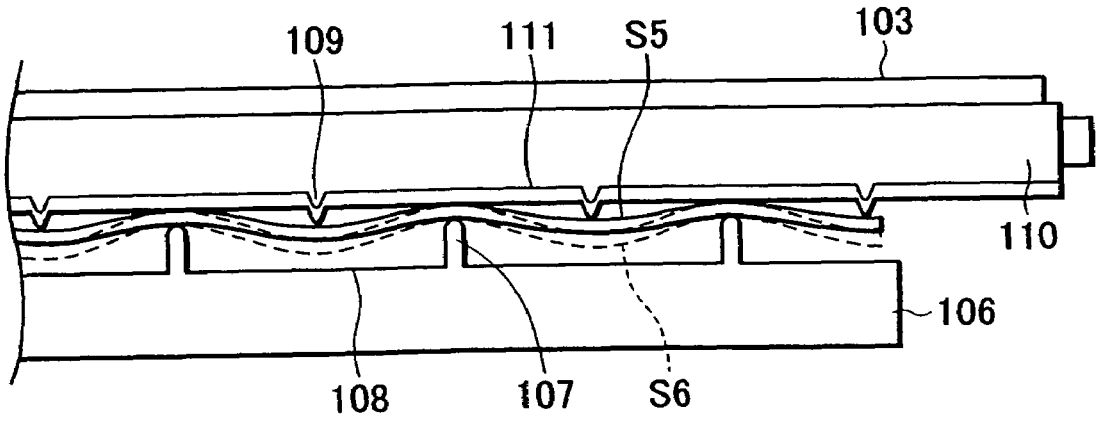
FIG. 13 PRIOR ART
FIG. 13 is a view of the recording apparatus shown in FIG. 12 from the direction of the arrow C, describing the behavior of recording sheets.
Figure 14:
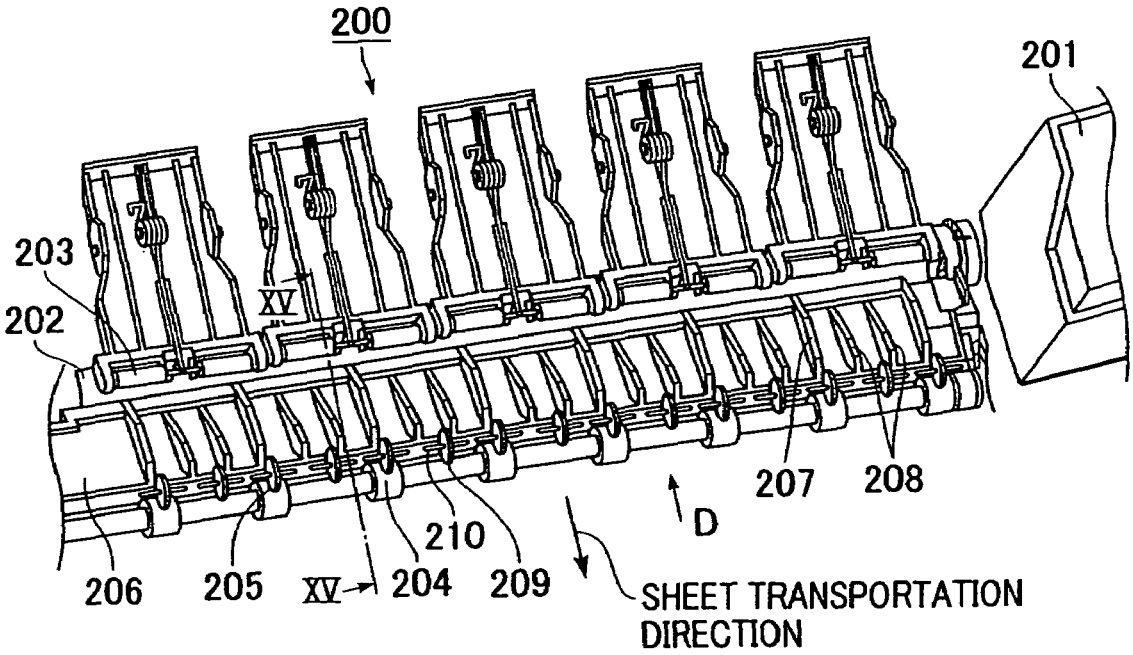
FIG. 14 PRIOR ART
FIG. 14 is a perspective view of a recording apparatus according to a second conventional example.
Figure 15:
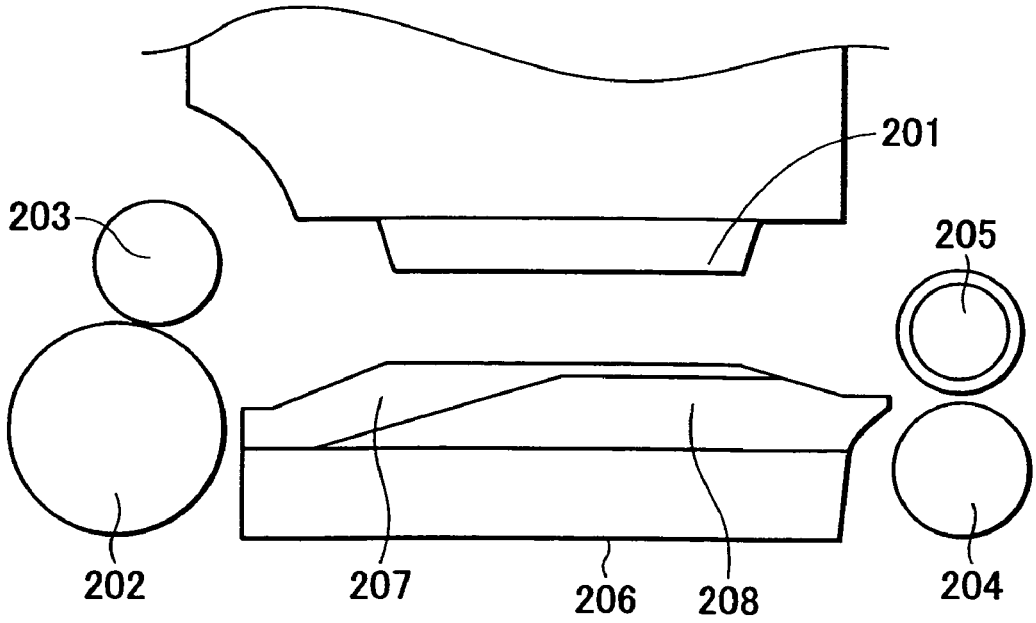
FIG. 15 PRIOR ART
FIG. 15 is a cross-section of the recording apparatus shown in FIG. 14 along line XV-XV.
Figure 16:
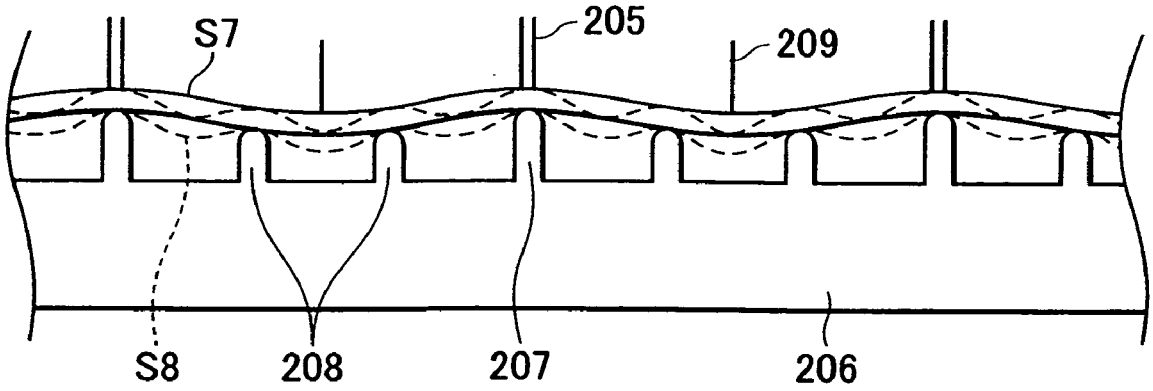
FIG. 16 PRIOR ART
FIG. 16 is a view of the recording apparatus shown in FIG. 14 from the direction of the arrow F, describing the behavior of recording sheets.

With the above-described embodiments, wave holding spurs 11 and ridge spurs 14 are directly pressed against the ridges 9 and the grooves 10 on the platen 7, but with the recording apparatus according to the present embodiment, in the state there is no recording sheet S on the platen the lower face of the perimeter of the spurs is maintained at the same height or lower than the face of the ridges 9 and grooves 10, and slits are provided on the platen 7 so that the spurs do not come into contact therewith, as shown in FIG. 10.

In FIG. 10, wave holding spurs 23 are rotatably supported on the center of rotation thereof by torsion coil springs 25 so as to be capable of elastic movement in the height-wise direction. Also, the height of the lower face of the perimeter thereof is maintained at the same height or lower than the face of the grooves 10 by unshown spur holders. In the same way, wave holding spurs 24 are rotatably supported on the center of rotation thereof by torsion coil springs 26 so as to be capable of elastic movement in the height-wise direction. Also, the height of the lower face of the perimeter thereof is maintained at the same height or lower than the face of the ridges 9 by unshown spur holders. Also, slits 27 are provided in the grooves 10 where the wave holding spurs 23 are provided, such that the wave holding spurs 23 do not come into contact with the grooves 10. In the same way, slits 28 are also provided in the ridges 9 where the wave holding spurs 24 are provided, such that the wave holding spurs 24 do not come into contact with the ridges 9. Accordingly, upon the recording sheet S reaching the wave holding spurs 23 and 24, the wave holding spurs 23 and 24 rotate in accordance with this movement and also move upwards from the ridges 9 and grooves 10 by a distance corresponding to the thickness of the recording sheet S. The slits 27 and 28 are formed just wide enough that the wave holding spurs 23 and 24 do not come into contact with the ridges 9 and the grooves 10, and accordingly the sheet S is never pressed into the slits 27 and 28. Accordingly, the attitude of the recording sheet S is the same as that described with the above other embodiments, with troughs of the waves at the grooves 10 and crests at the ridges 9.

With such a configuration, the wave holding spurs 23 and 24 do not come into contact with the platen 7 before the recording sheet S reaches the wave holding spurs 23 and 24, thereby preventing damage to the protrusions provided on the perimeter of the spurs, and also preventing scuffing of the platen 7 by these protrusions, consequently avoiding jamming or damage to the sheets due to the recording sheets S catching on such scuffled areas. Other advantages are the same as those of the second embodiment.

Eighth Embodiment

With the seventh embodiment, slits were directly provided in the platen 7, but with the recording apparatus according to the present embodiment, the slits are configured of rollers such as described with the sixth embodiment.

Ridge slit rollers 29 have small diameter portions **29*b* with a smaller diameter at the portion corresponding to the wave holding spurs 24 than the diameter of side portions 29*a*, and are provided downstream of the recording area on the platen 7 in a rotatable manner such that the upper face of the perimeter of the side portions 29*a* is generally the same height as the ridges 9. In the same way, groove slit rollers 30 have small diameter portions 30*b* with a smaller diameter at the portion corresponding to the wave holding spurs 23 than the diameter of side portions 30*a*, and are provided downstream of the recording area on the platen 7 in a rotatable manner such that the upper face of the perimeter of the side portions 30*a* is generally the same height as the grooves 10. That is to say, the small diameter portions 29*b* and 30*b* between the side portions 29*a* and 30*a* of the ridge slit rollers 29 and the groove slit rollers 30** according to the present embodiment function in the same way as with the slits described in the sixth embodiment. The advantages of both the sixth and seventh embodiments can be realized with this arrangement.

Needless to say, two or more of the above-described embodiments may be combined to configure a recording apparatus, and while the wave providing means upstream of the recording area has been described based on the configuration in the second conventional example, this may be based on the configuration in the first conventional example, and does not in any way limit the wave providing means upstream.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus comprising:

transporting means for transporting recording sheets in a transporting direction;

a platen, positioned facing a recording head which records on the recording sheets, comprising ridges extending in the transporting direction;

transporting roller pairs disposed downstream of said recording head for nipping and transporting the recording sheets;

first roller members rotatably supported by said platen between said recording head and said transporting roller pairs, wherein said first roller members are aligned in the transportation direction with said ridges, wherein said first roller members are generally the same height as said ridges, and wherein first slits are formed at peripheral surfaces of said first roller members;

second roller members rotatably supported by said platen between said ridges, wherein said second roller members are generally the same height as a portion of the platen between said ridges, and wherein second slits are formed at peripheral surfaces of said second roller members;

first rotating members rotatably supported for nipping and transporting the recording sheets in cooperation with said first roller members, and facing said first slits such that said first rotating members do not contact with said first roller members; and second rotating members rotatably supported for nipping and transporting the recording sheets in cooperation with said second roller members, and facing said second slits such that said second rotating members do not contact with said second roller members.

* * * * *

UNITED STATES PATENT AND TRADEMARK OFFICE

CERTIFICATE OF CORRECTION

PATENT NO. : 7,232,269 B2
APPLICATION NO. : 11/092828
DATED : June 19, 2007
INVENTOR(S) : Ohyama It is certified that error appears in the above-identified patent and that said Letters Patent is hereby corrected as shown below:

ON THE TITLE PAGE:
At Item (62), Related U.S. Application Data, "Pat. No. 6,896,432." should read --U.S. Pat. No. 6,896,432.--.

At Item (56), Foreign Patent Documents, "09086749 A" should read --9-86749 A--, "09193373 A" should read --9-193373 A--, and "2000335801 A" should read --2000-335801 A--.

COLUMN 10:
Line 67, "sheet" should read --sheet,--.

Signed and Sealed this

Twenty-fourth Day of February, 2009

JOHN DOLL
*Acting Director of the United States Patent and Trademark Office*